US010962243B2

(12) United States Patent
Bush et al.

(10) Patent No.: US 10,962,243 B2
(45) Date of Patent: Mar. 30, 2021

(54) AIR CONDITIONING SYSTEM WITH DEHUMIDIFICATION MODE

(71) Applicant: Mitsubishi Electric US, Inc., Cypress, CA (US)

(72) Inventors: Joseph Bush, Suwanee, GA (US); So Nomoto, Suwanee, GA (US)

(73) Assignee: Mitsubishi Electric US, Inc., Cypress, CA (US)

( * ) Notice: Subject to any disclaimer, the term of this patent is extended or adjusted under 35 U.S.C. 154(b) by 1612 days.

(21) Appl. No.: 14/579,525

(22) Filed: Dec. 22, 2014

(65) Prior Publication Data

US 2016/0178222 A1 Jun. 23, 2016

(51) Int. Cl.

| | |
|---|---|
| ***F24F 5/00*** | (2006.01) |
| ***F24F 3/14*** | (2006.01) |
| ***F24F 11/30*** | (2018.01) |
| *F24F 110/10* | (2018.01) |
| *F24F 110/20* | (2018.01) |
| *F24F 11/65* | (2018.01) |

(52) U.S. Cl.

CPC ..... *F24F 5/001* (2013.01); *F24F 3/14* (2013.01); *F24F 3/1405* (2013.01); *F24F 11/30* (2018.01); *F24F 11/65* (2018.01); *F24F 2110/10* (2018.01); *F24F 2110/20* (2018.01)

(58) Field of Classification Search

CPC .. F24F 3/153; F24F 3/14; F24F 3/1405; F24F 2003/1446; F24F 2003/1452

USPC ..... 62/176.1, 176.3

See application file for complete search history.

(56) References Cited

U.S. PATENT DOCUMENTS

| | | | | |
|---|---|---|---|---|
| 4,000,779 | A | 1/1977 | Irwin | |
| 5,622,057 | A | 4/1997 | Bussjager et al. | |
| 6,826,921 | B1 * | 12/2004 | Uselton | F24F 3/153 62/176.6 |
| 8,220,277 | B2 * | 7/2012 | Dieckmann | F24F 3/153 62/93 |
| 2009/0277193 | A1 * | 11/2009 | Springer | F24F 3/153 62/93 |
| 2010/0307175 | A1 * | 12/2010 | Teige | F24F 3/1423 62/94 |
| 2011/0276185 | A1 | 11/2011 | Watanabe | |
| 2017/0356661 | A1 * | 12/2017 | Fischer | F24F 3/147 |

* cited by examiner

*Primary Examiner* — Nelson J Nieves
*Assistant Examiner* — Meraj A Shaikh
(74) *Attorney, Agent, or Firm* — Posz Law Group, PLC

(57) ABSTRACT

An air conditioning system with precisely controlled dehumidification functions is disclosed. The air conditioning system comprises an indoor air handling system comprising a primary heat exchanger and a secondary heat exchanger. The indoor air handling system can be coupled to an outdoor unit comprising a compressor and an outdoor heat exchanger. When a controller system receives a measured humidity that exceeds a set humidity, the controller system can increase the cooling capacity of the air conditioning system to meet a set temperature. Once the set temperature is met, the controller system can switch to a dehumidification mode wherein the primary heat exchanger is cooled and the secondary heat exchanger is activated. When the measured temperature exceeds the set temperature, the controller system can switch from the dehumidification mode back to cooling mode.

12 Claims, 7 Drawing Sheets

AIR CONDITIONING SYSTEM WITH DEHUMIDIFICATION MODE

TECHNICAL FIELD

The present disclosure relates generally to an improved air conditioning system and particularly to an air conditioning system with a precisely controlled dehumidifying mode.

BACKGROUND

Compression type air conditioners both cool the temperature of air and provide dehumidifying functions by removing moisture from the air. Dehumidifying the air typically occurs when warm air passes over an evaporator coil and moisture in the warm air condenses on the cool evaporator coils. This dehumidifying function works relatively well when the outdoor temperature is relatively high because the air conditioning system will typically be running regularly at a high capacity.

However, the dehumidifying function does not work as well with existing air conditioning systems when outdoor temperatures are not as high but the humidity remains high. When the outdoor temperature is not relatively high, for example less than 80 F, existing air conditioning systems may not run as frequently. In such situations, there is less opportunity for the air conditioning system to perform the dehumidifying function.

People may attempt to address this situation by lowering the temperature setting to force the air conditioning system to operate. However, lowering the temperature setting creates a cooler than necessary environment in the home (referred to as "over cooling") while still leaving the home environment with relatively high humidity.

Other attempts to address this problem have involved the use of variable speed fans and two-speed or variable speed compressors. However, these systems will not operate to remove moisture if there is no heat load, such as when the outdoor temperatures are relatively mild. Therefore, these solutions have had limited success.

The ability to remove moisture from the environment is also limited in the foregoing systems because they normally operate with an indoor evaporator coil temperature of approximately 45 F. Existing air conditioning systems could remove moisture more effectively if the indoor evaporator coil operated at a temperature cooler than 45 F.

Another existing approach to improve dehumidification is to place an indoor reheat coil in the discharge air stream of the cooled air exiting the indoor evaporator coil. This indoor reheat coil is placed in series with the outdoor condenser coil such that the indoor reheat coil can take heat from the warmed refrigerant prior to the warmed refrigerant flowing to the expansion valve and into the indoor evaporator coil. The indoor reheat coil uses the heat from the warmed refrigerant to warm the cool air exiting the indoor evaporator coil. However, this existing approach has the following limitations:

a. the amount of heat that can be discharged by the indoor reheat coil performing reheating is limited and therefore insufficient to reheat the cooled air to the room neutral or set temperature if there is insufficient heat load;
b. when the outdoor temperature is relatively cool, there is less heat available in the warmed refrigerant to reheat the cooled air exiting the indoor evaporator coil; and
c. the indoor evaporator coil typically operates at a lowest temperature of approximately 45 F, which limits the amount of moisture that can be removed from the air passing through the indoor evaporator coil.

Therefore, in view of the limitations in existing air conditioning systems, there is a need for a system that provides improved dehumidification. There is a further need for a system that provides improved dehumidification while also providing air to the indoor environment at the set temperature to avoid over cooling the indoor environment. There is also a need for a system that provides improved dehumidification without interfering with the cooling functions of the air conditioning system.

SUMMARY

In general, in one aspect of the present disclosure, an example air conditioning system comprises an outdoor unit comprising a condenser coil with an input and an output and a compressor with a compressor output in fluid communication with the condenser coil input. The air conditioning system also comprises an indoor air handling unit comprising an evaporator coil, a reheat coil, and a reheat coil valve disposed at an input of the reheat coil. The output to the evaporator coil is in fluid communication with the compressor input. The input of the evaporator coil is in fluid communication with the output of the reheat coil. The reheat coil also has an input that is in fluid communication with the condenser coil. The indoor air handling unit further comprises a controller system that can switch the air conditioning system from a cooling mode to a dehumidification mode. In connection with switching the air conditioning system from a cooling mode to a dehumidification mode, the controller system can increase the capacity of the cooling mode to ensure the system reaches a set temperature before switching to the dehumidification mode.

In another aspect, the present disclosure describes an example air conditioning system comprising an outdoor unit comprising an outdoor heat exchanger and a compressor coupled to the outdoor heat exchanger. The air conditioning system also comprises an indoor unit comprising an indoor primary heat exchanger, an indoor secondary heat exchanger, and a secondary valve disposed at an input to the secondary heat exchanger. The indoor primary heat exchanger comprises a primary input coupled to the outdoor heat exchanger and a primary output coupled to the compressor. The indoor secondary heat exchanger comprises a secondary input coupled to the outdoor heat exchanger and a secondary output coupled to the primary input. The example air conditioning system also comprises a controller system operable for switching the air conditioning system between a cooling mode and a dehumidification mode. In the dehumidification mode, the controller system can increase the cooling capacity of the indoor unit.

In yet another aspect, the present disclosure describes an example air conditioning system comprising an indoor air handling unit, for example, that could be used to retrofit an existing air conditioning system. The example indoor air handling unit comprises an indoor primary heat exchanger, an indoor secondary heat exchanger, and a secondary valve disposed at a secondary input of the indoor secondary heat exchanger. The indoor primary heat exchanger comprises a primary input configured to be coupled to an outdoor heat exchanger and a primary output configured to be coupled to an input of a compressor. The indoor secondary heat exchanger comprises a secondary input configured to be coupled to an outdoor heat exchanger and a secondary output coupled to the primary input. The indoor air handling unit also comprises a controller system operable for switching the air conditioning system between a cooling mode and a dehumidification mode. Prior to switching to a dehumidification mode, the controller system can increase the capacity of the air conditioning system in the cooling mode to ensure the system reaches a set temperature.

These and other aspects, objects, features, and embodiments will be apparent from the following description and the appended claims.

BRIEF DESCRIPTION OF THE DRAWINGS

The drawings illustrate only example embodiments the disclosure and are therefore not to be considered limiting of its scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
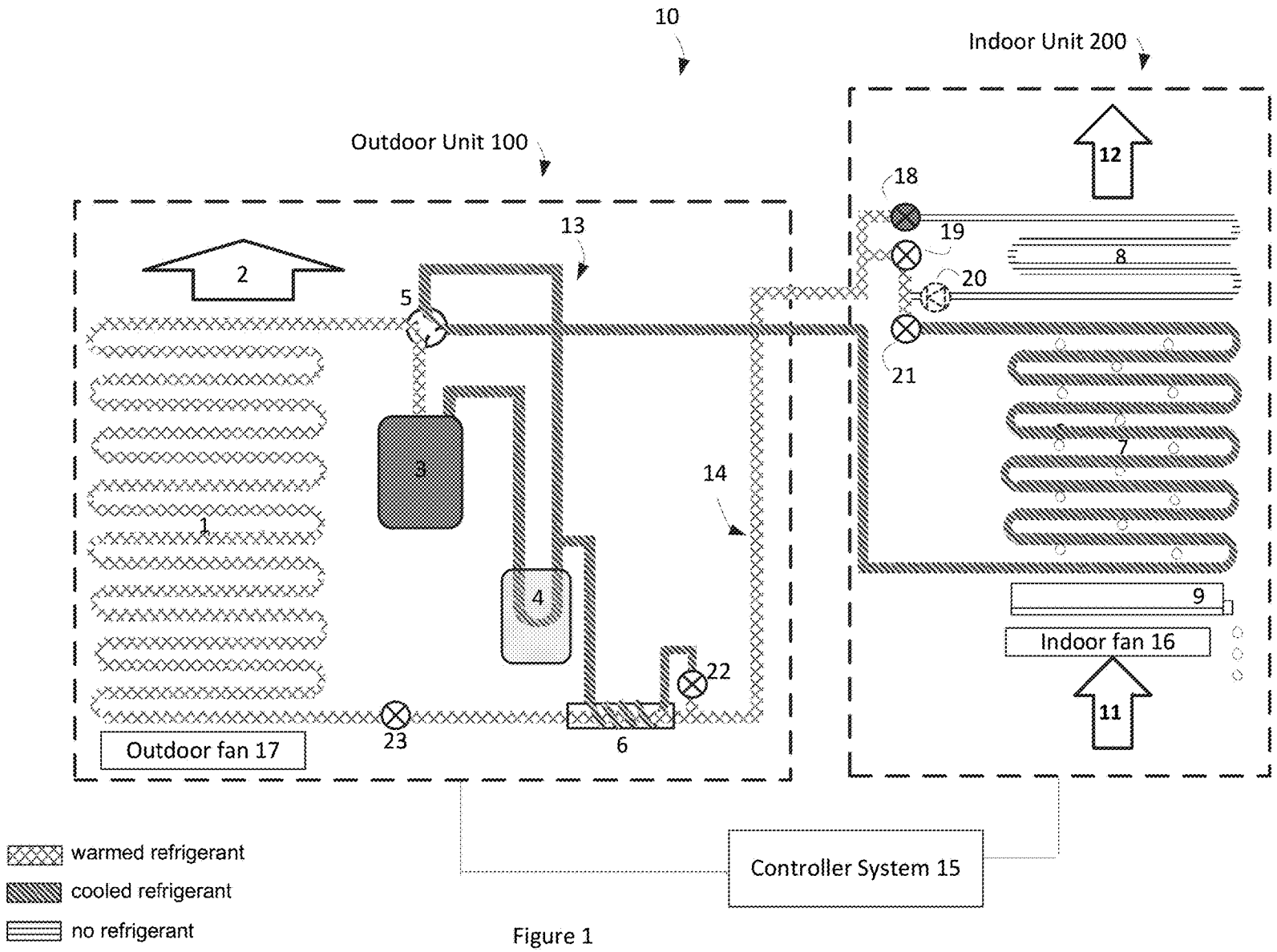
FIG. 1 illustrates a schematic diagram of an air conditioning system during a cooling operation with high humidity in accordance with an example embodiment of the present disclosure.

The example embodiments discussed herein are directed to systems, apparatuses, and methods for compression type air conditioning systems. Those of skill in this field will recognize that the examples provided herein are not limiting and alternate embodiments can be implemented within the scope of the present disclosure. Those of skill in the field will also recognize that conventional components known in the art are not included in the figures so as not to obscure the example embodiments. Furthermore, those of skill in the field will recognize that the example embodiments shown in the figures are intended to be illustrative and that the components can be modified and arranged differently in alternate embodiments without departing from the scope of the present disclosure.

Like, but not necessarily the same, elements (also sometimes called components) in the various figures are denoted by like reference numerals for consistency. Terms such as "first," "second," "top," and "bottom" are used merely to distinguish one component (or part of a component) from another. Such terms are not meant to denote a preference or a particular orientation.

Unless otherwise noted, the term "temperature" as used herein refers to a dry-bulb temperature. Unless otherwise noted, the term "humidity" as used herein refers to a relative humidity.

Figure 2:
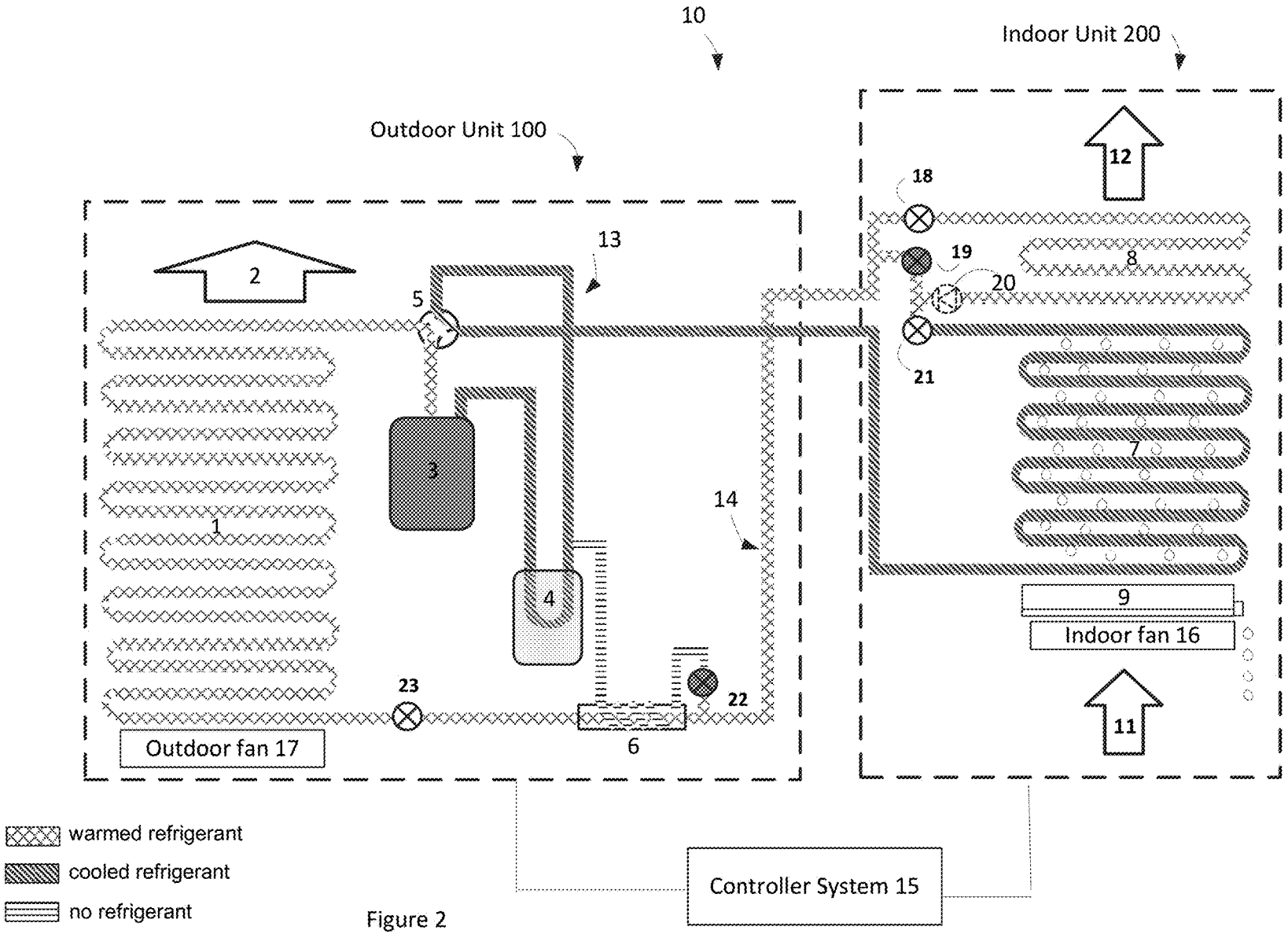
FIG. 2 illustrates a schematic diagram of an air conditioning system during a dehumidifying operation with high humidity in accordance with an example embodiment of the present disclosure.

Referring now to FIGS. 1 and 2, a schematic diagram is shown of a compression type air conditioning system 10 in accordance with an example embodiment of the present disclosure. FIGS. 1 and 2 illustrate the operation of the example air conditioning system 10 when the outdoor temperature is relatively high, for example, above 80 F and the humidity within the indoor environment is above approximately 45%. FIG. 1 illustrates an example of the air conditioning system 10 operating in a cooling mode and FIG. 2 illustrates an example of the air conditioning system 10 operating in a dehumidification mode.

FIGS. 1 and 2 illustrate a heat pump type of air conditioning system with a reversing valve 5. The reversing valve 5 allows the system to switch the direction in which the refrigerant flows thereby permitting the system to provide both heating and cooling. It should be understood that the example embodiments disclosed herein can be applied to heat pump type air conditioning systems as well as air conditioning systems that do not have a reversing valve 5 that permits operation as a heat pump.

The example air conditioning system 10 comprises an outdoor unit 100 and an indoor unit 200. The indoor unit 200 is also referred to herein as the indoor air handling unit because it is the unit that is typically located within the building or structure and handles the flow of air within the building or structure. Those of skill in the art will recognize that in alternate embodiments of this disclosure, the outdoor unit 100 and the indoor unit 200 may be provided as separate components or may be compatible with other systems. For example, in a retrofit application, indoor unit 200 may be installed to operate with existing outdoor units that may vary from outdoor unit 100 shown in FIG. 1.

Outdoor unit 100 shown in FIGS. 1 and 2 comprises an outdoor heat exchanger 1, a compressor 3, a suction accumulator 4, and refrigerant lines 13 and 14. The outdoor heat exchanger 1 can take a variety of forms including that of a refrigerant fluid condenser comprising a coil. The outdoor heat exchanger 1 typically has an outdoor fan 17 that drives ambient air 2 over the surface of the heat exchanger 1. While not shown in FIGS. 1 and 2, the outdoor fan 17 can be driven by a variety of means, including an electric motor which may have variable speeds or multiple speeds. In an example embodiment, the compressor 3 compresses the refrigerant fluid which then flows to the outdoor heat exchanger 1. The outdoor heat exchanger 1 condenses the refrigerant fluid and the condensed fluid then feeds via refrigerant line 14 to an indoor heat exchanger. The heat exchanger 1 can also have an expansion device, such as the expansion valve 23 shown in FIGS. 1 and 2, positioned at the output of the heat exchanger 1. Cooled refrigerant returns to the compressor 3 from an indoor heat exchanger via refrigerant line 13.

The outdoor unit 100 shown in FIGS. 1 and 2 also includes a subcooling heat exchanger 6 and expansion valve 22. The subcooling heat exchanger 6 cools the warmed refrigerant flowing through refrigerant line 14 to the indoor unit 200. The subcooling heat exchanger 6 is an optional component and in alternate embodiments it need not be present. As described further below, the subcooling heat exchanger 6 would typically be deactivated when the air conditioning system 10 is operating in a dehumidification mode as shown in FIG. 2.

As shown in FIGS. 1 and 2, the outdoor unit 100 is coupled to the indoor unit 200 via refrigerant lines 13 and 14. The indoor unit 200 comprises a primary indoor heat exchanger 7 and a secondary indoor heat exchanger 8. In one example embodiment, the primary indoor heat exchanger 7 can be an evaporator coil and the secondary indoor heat exchanger 8 can be a reheat coil. When operating in a cooling mode, the primary indoor heat exchanger 7 cools return air 11 that flows over the surfaces of the exchanger 7. As shown in FIGS. 1 and 2, a drain pan 9 can be disposed below the primary indoor heat exchanger 7. The indoor fan 16 can be disposed either below or above the primary indoor heat exchanger 7 and can be operated by a multiple speed or variable speed electric motor to push or pull air over the surfaces of the primary indoor heat exchanger 7. The drain pan 9 collects condensate that accumulates on the primary indoor heat exchanger 7 as air passes over the exchanger. Dehumidification of the return air 11 occurs when the condensate accumulates on the primary indoor heat exchanger 7 thereby removing moisture from the return air 11. Conditioned air 12 that is cooler and drier exits the indoor unit 200 and is returned to the indoor environment that is being cooled.

The secondary indoor heat exchanger 8 would typically be de-energized when the air conditioning system 10 is operating in a cooling mode as shown in FIG. 1. As described further below, the secondary indoor heat exchanger 8 is energized in a dehumidification mode as shown in FIG. 2. Also shown in FIGS. 1 and 2 are valves 18 and 19, an expansion valve 21, and a check valve 20. The valves shown in FIGS. 1 and 2 are merely one example embodiment and in alternate embodiments a different arrangement of valves can be implemented. For example, an alternate embodiment may eliminate valve 19 and/or check valve 20. Valve 18 (also referred to as the secondary valve) is positioned at the input of the secondary indoor heat exchanger 8 and controls the flow of warmed refrigerant into the secondary heat exchanger 8. In the example cooling mode shown in FIG. 1, valve 18 is closed and the refrigerant is directed towards the primary indoor heat exchanger 7. In contrast, in the example dehumidification mode shown in FIG. 2, the valve 18 is open permitting warmed refrigerant to flow into the secondary indoor heat exchanger 8. The check valve 20 is shown disposed at the output of the secondary indoor heat exchanger 8 and serves to prevent refrigerant from flowing back into the output of the secondary heat exchanger 8. In alternate embodiments, the check valve 20 may be unnecessary and can be removed.

Example air conditioning system 10 also comprises a controller system 15. The controller system 15 can comprise one or more controllers that operate the components of the air conditioning system 10. In FIGS. 1 and 2, the controller system 15 is shown as a separate component from the outdoor unit 100 and the indoor unit 200. However, in other embodiments, the controller system 15 can be implemented as part of the indoor unit 200 or it can be distributed as multiple components in different locations. The controller system 15 can be implemented using a variety of components including a hardware processor-based component that executes software instructions using integrated circuits, volatile and non-volatile memory for storing software instructions and other input, network and communications interfaces, and/or other mechanical and/or electronic architecture. In addition, or in the alternative, the controller system 15 can include one or more of a number of other programmable components. The controller system 15 can be programmed or controlled via a user interface. The user interface is typically mounted separately within the indoor environment that is being air conditioned and permits a user to communicate temperature and humidity settings, as well as scheduling information and other settings, to the controller system 15.

The controller system 15 can coordinate the operation of the air conditioning system 10. For example, the controller system 15 can generate and send instructions, receive information (e.g., data), perform calculations, perform evaluations, compare measured or calculated values against set or threshold values, generate and send notifications, control devices, send information (e.g., data), receive instructions, follow commands, and communicate with other devices. Referring again to FIGS. 1 and 2, the controller system 15 can control the compressor 3, the indoor and outdoor fans 16 and 17, the reversing valve 5, and one or more valves shown in the outdoor unit 100 and the indoor unit 200. The controller system 15 can also receive data from one or more detectors, such as a temperature detector and a humidity detector. Although not shown in the figures, temperature and humidity detectors are well known in the field. The temperature and humidity detectors can take measurements of the air within the indoor environment to be controlled by the air condition system 10 and the detectors can supply the measurements to the controller system 15 for using in various control operations.

As explained above, FIGS. 1 and 2 illustrate the operation of the example air conditioning system 10 when the outdoor temperature is relatively high, for example, above 80 F and the humidity within the indoor environment is above approximately 45%. FIG. 1 shows the air conditioning system 10 operating in a cooling mode, whereas FIG. 2 shows the system operating in a dehumidification mode. In FIG. 1, return air 11 is being cooled and dried by the refrigerant in the primary indoor heat exchanger 7 and the secondary indoor heat exchanger 8 is deactivated. The temperature of the primary indoor heat exchanger 7 in cooling mode would typically be approximately 45 F.

When the controller system 15 has a demand for dehumidification based on the humidity measured by the humidity detector, the controller system 15 can begin the process of switching from cooling mode to dehumidification mode. Because the air conditioning system 10 is designed such that temperature is more important than humidity, before switching to dehumidification mode, the controller system 15 will ensure that the measured temperature (Tm) within the indoor environment meets the set temperature (Ts) determined by the user providing input to the controller system 15. The controller system 15 can increase the cooling capacity of the air conditioning system 10 by, for example, increasing the frequency of the compressor 3. Increasing the cooling capacity of the air conditioning system 10 allows the system to achieve Ts more quickly so that the system can then switch to dehumidification mode.

FIG. 2 shows the air conditioning system 10 operating in dehumidification mode. In dehumidification mode, the controller system 15 slows the indoor fan 16 while also increasing the operation of the compressor 3 to bring the primary indoor heat exchanger 7 down to a temperature of approximately 34 F. In alternate embodiments, when switching to dehumidification mode, the controller system 15 may only perform one of slowing the indoor fan 16 and increasing the operation of the compressor 3. When the primary indoor heat exchanger 7 operates at a cooler temperature and the indoor fan 16 operates at a slower speed, dehumidification of the return air 11 is maximized thereby reducing the humidity in the indoor environment. However, because the primary indoor heat exchanger 7 is operating at a colder temperature and the indoor fan 16 is operating at a slower speed, the conditioned air 12 would be too cold for the indoor environment. Therefore, as shown in FIG. 2, the secondary indoor heat exchanger 8 is energized and operates to raise the temperature of the air exiting the primary indoor heat exchanger 7 before the air is circulated in the indoor environment. In the dehumidification mode shown in FIG. 2, the secondary indoor heat exchanger 8 is energized when the valve 18 is opened and warmed refrigerant is able to flow through the secondary indoor heat exchanger 8.

In the dehumidification mode shown in FIG. 2, the controller system 15 also adjusts the outdoor unit 100 to optimize the operation of the air conditioning system. For example, the controller system 15 can close expansion valve 22 and deactivate the subcooling heat exchanger 6 while also reducing the capacity of the outdoor heat exchanger 1 in order to optimize the amount of heat the secondary indoor heat exchanger 8 delivers to the air. The controller system 15 can reduce the capacity of the outdoor heat exchanger 1 by one or more of slowing the outdoor fan 17, redirecting the flow of air around the outdoor heat exchanger 1 by adjusting louvres on the exchanger, and closing off portions of the coil within the outdoor heat exchanger 1. The controller system 15 will continue to operate the air conditioning system 15 in dehumidification mode until the measured humidity (Hm) meets the set humidity (Hs) or until the measured temperature (Tm) increases and the system must switch back to cooling mode.

Figure 3:
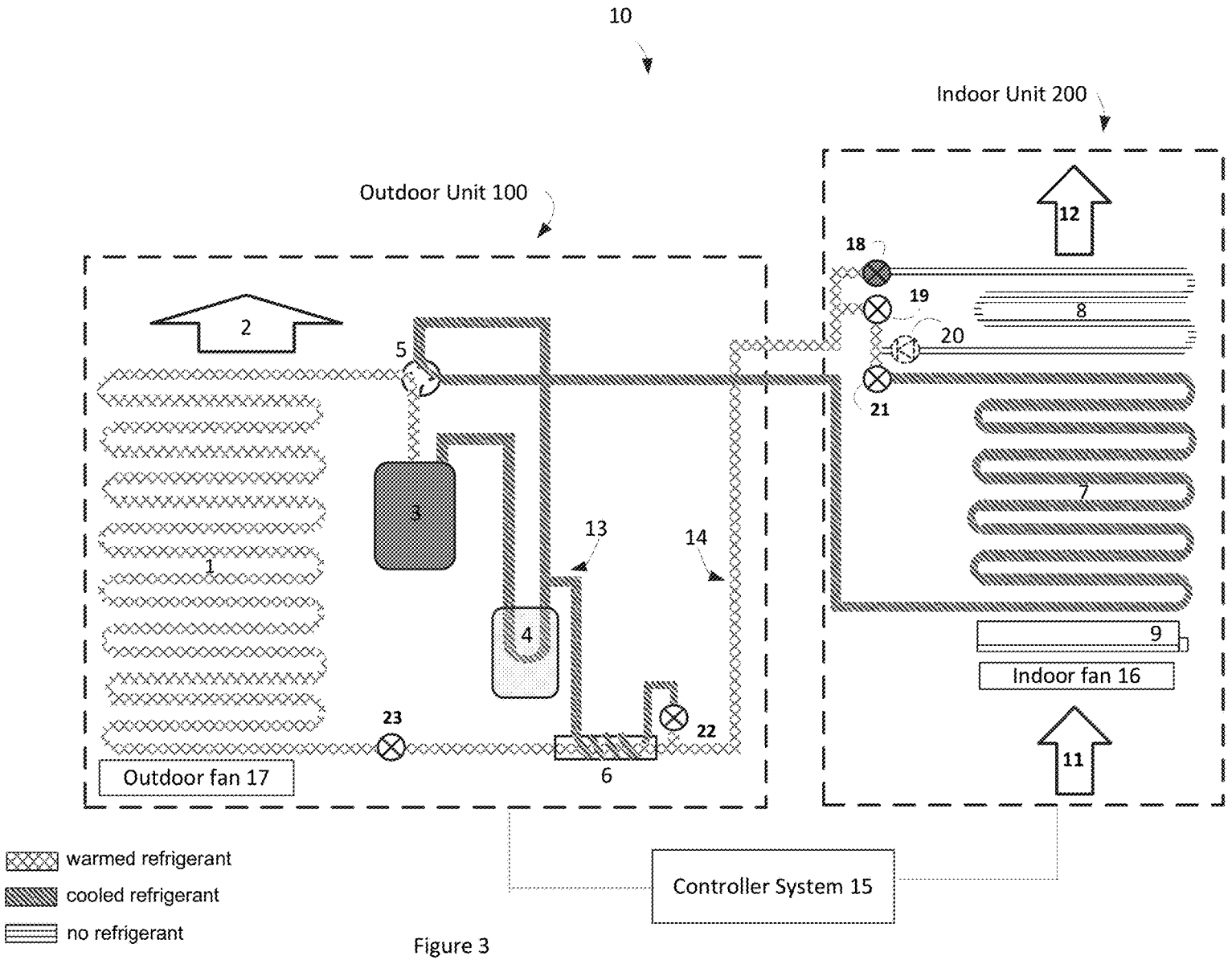
FIG. 3 illustrates a schematic diagram of an air conditioning system during a cooling operation with low humidity in accordance with an example embodiment of the present disclosure.
Figure 4:
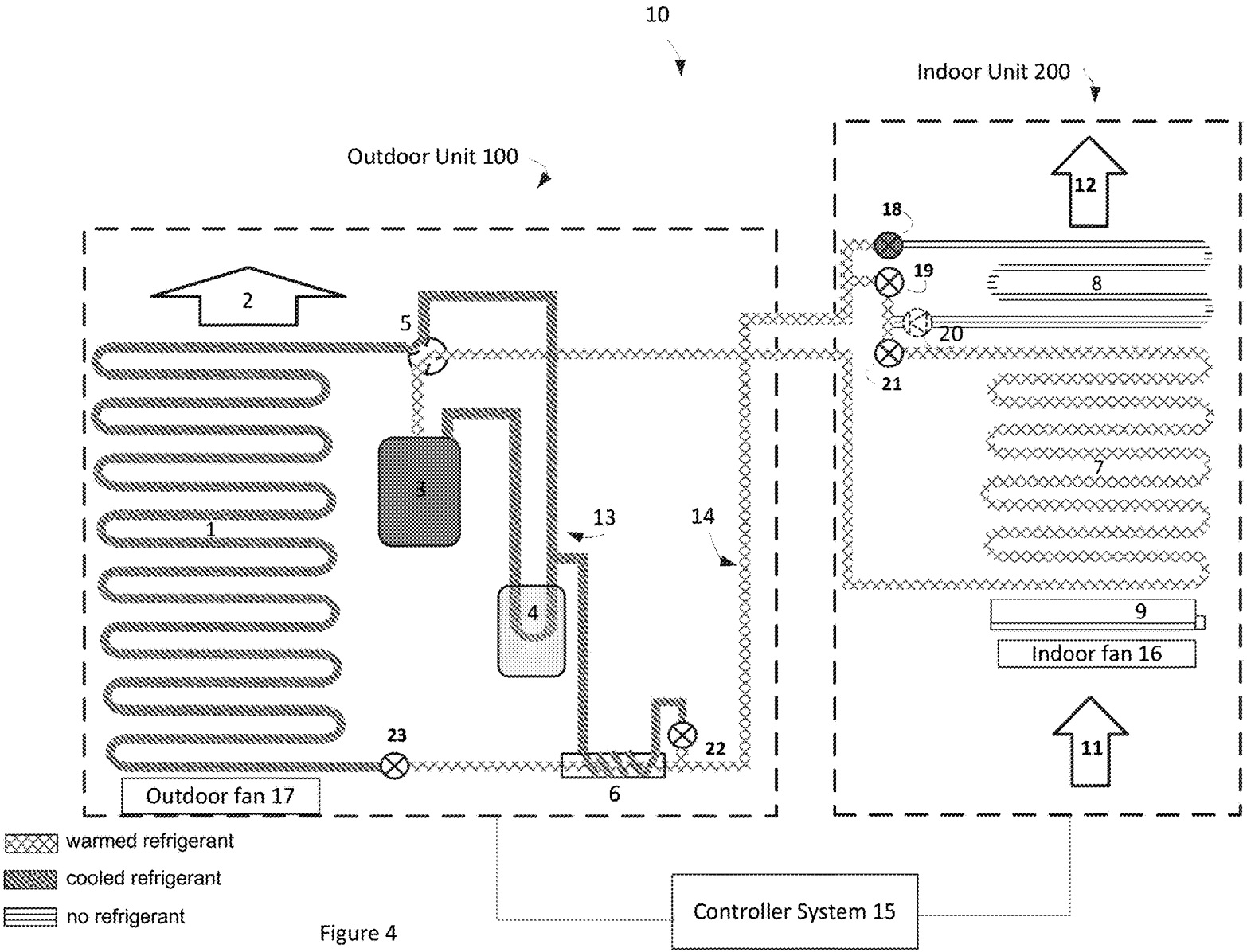
FIG. 4 illustrates a schematic diagram of an air conditioning system during a heating operation in accordance with an example embodiment of the present disclosure.
Figure 5:
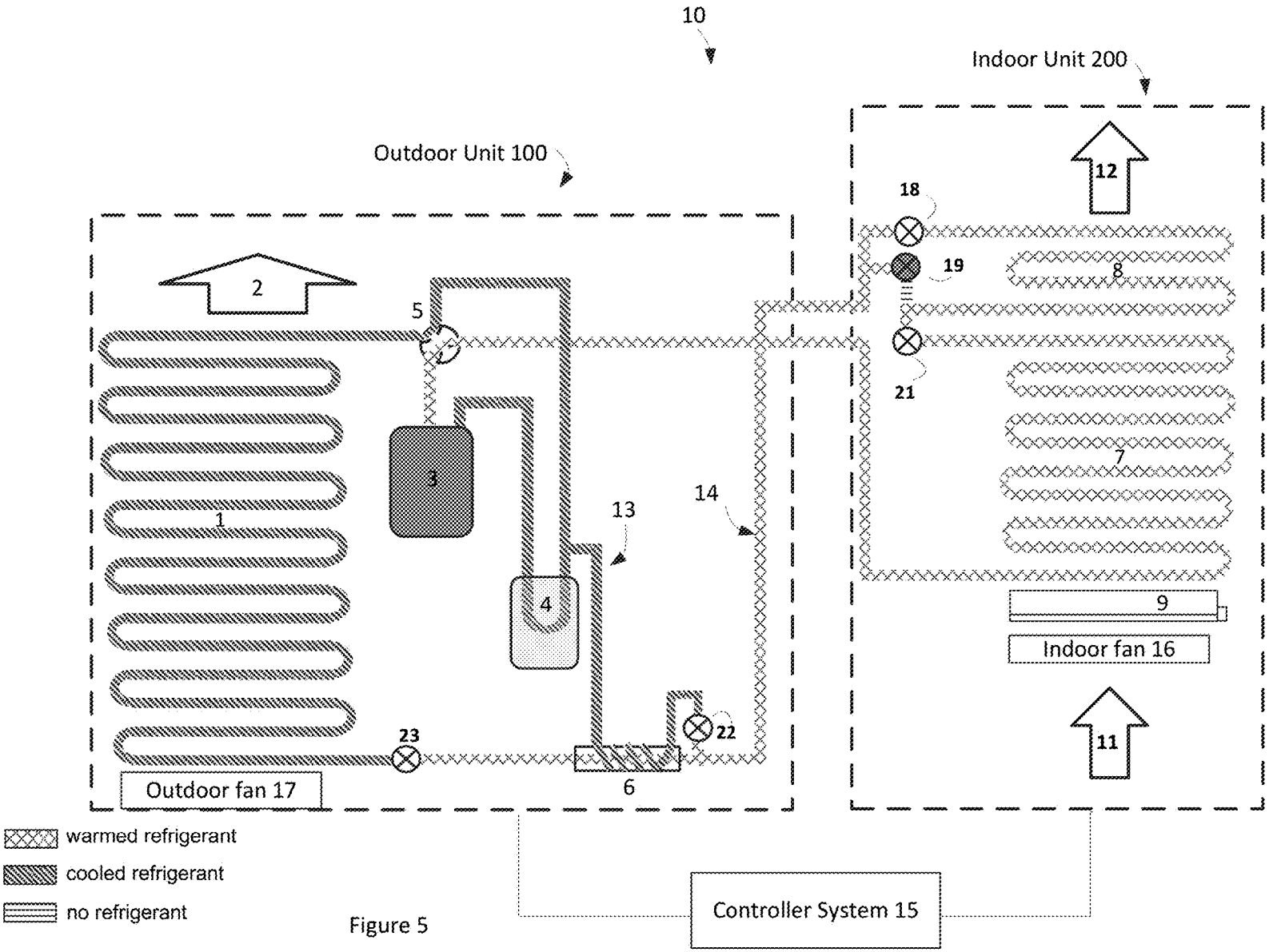
FIG. 5 illustrates a schematic diagram of an air conditioning system during a heating operation in accordance with an example embodiment of the present disclosure.

FIGS. 3, 4, and 5 show examples of the same air conditioning system 10, but operating under different circumstances. Much of the previous discussion regarding the components shown in FIGS. 1 and 2 applies to the same components shown in FIGS. 3, 4, and 5.

In FIG. 3, air conditioning system 10 is operating in cooling mode with the indoor humidity below approximately 45% because the humidity has been reduced by the dehumidification mode illustrated in FIG. 2. Therefore, in the example circumstance illustrated in FIG. 3, the air conditioning system 10 only needs to operate in cooling mode, without switching periodically to dehumidification mode, and can operate more efficiently because there is no latent load that would be present at higher humidity levels. In one example, this greater efficiency permits the air conditioning system 10 to operate at approximately 60-70% of its total cooling capacity.

FIGS. 4 and 5 show the air conditioning system 10 with the reversing valve 5 actuated so that the system operates in heating mode. In heating mode, the indoor humidity is typically below approximately 45% and therefore there is no need for dehumidification. As shown in FIG. 4, the air conditioning system 10 can be operated in a heating operation as a standard heat pump without using the secondary indoor heat exchanger 8. Alternatively, in FIG. 5, the secondary indoor heat exchanger 8 can be used in a heating operation for greater efficiency. In the embodiment illustrated in FIG. 5, the check valve 20 is not present.

Figure 6:
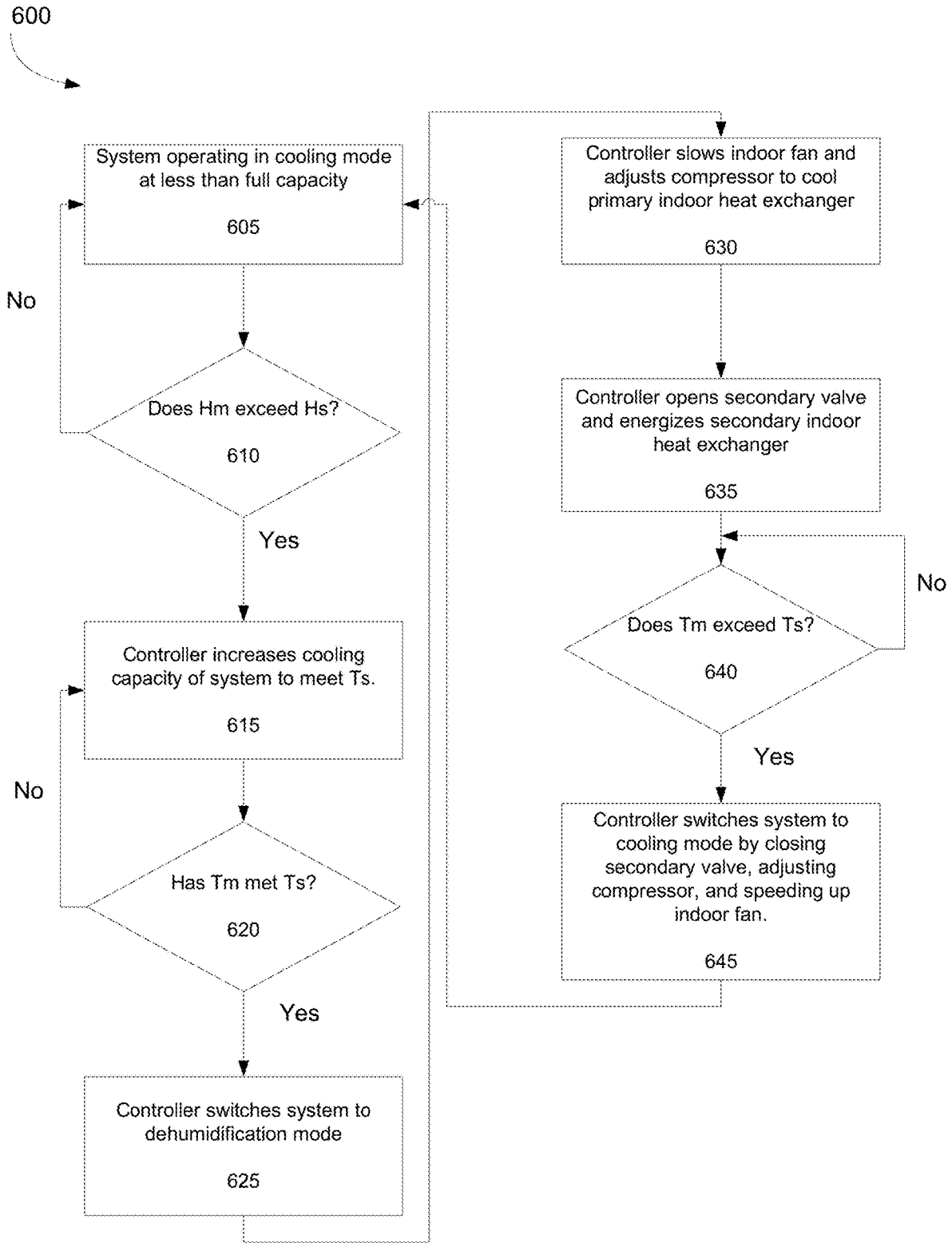
FIG. 6 illustrates a flow chart diagram showing the operation of a controller in accordance with an example embodiment of the present disclosure.

Turning to FIG. 6, a flow chart illustrating example method 600 is provided. Method 600 is merely one method of operating the air conditioning system 10 and in alternate embodiments certain steps can be modified. Referring to example method 600 shown in FIG. 6 and the discussion of the components of the air conditioning system in FIGS. 1-5, the method begins with the air conditioning system 10 operating in a cooling mode at less than full capacity. By operating at less than full capacity, the air conditioning system 10 operates in cooling mode for longer periods of time instead of turning on and off more frequently. While operating in cooling mode at less than full capacity allows the air conditioning system 10 to operate more efficiently, it provides less opportunity for the air conditioning system 10 to operate in a dehumidification mode when needed to reduce humidity in the indoor environment. Accordingly, method 600 permits the air conditioning system 10 to operate in dehumidification mode when needed and permits the system 10 to operate in cooling mode at less than full capacity at other times in order to maximize efficiency.

The controller system 15 regularly receives data on the measured humidity (Hm) in the indoor environment. While Hm does not exceed a set humidity (Hs), the air conditioning system 10 will continue to operate in cooling mode at less than full capacity. However, when Hm exceeds a set humidity (Hs) in step 610, the controller system 15 prepares for switching the system to dehumidification mode. Before switching the air conditioning system 10 to the dehumidification mode, the controller system 15 increases the cooling capacity of the air conditioning system 10 in step 615 in order to more quickly reach the set temperature (Ts). As illustrated in step 620, until the measured temperature (Tm) meets Ts, the controller system 15 will not switch the air conditioning system 10 to dehumidification mode. Once the temperature requirement is met in step 620, the controller system 15 will switch modes in step 625.

The controller system 15 can take several different actions in order to optimize the operation of the dehumidification mode. Examples of certain of those actions are illustrated in steps 630 and 635. For instance, the controller system 15 can slow the speed of the indoor fan 16 and increase the capacity of the compressor 3 in order reduce the temperature of the primary indoor heat exchanger 7. These two actions have a substantially increased cooling effect on the return air 11 thereby maximizing condensation and the removal of moisture from the air. In step 635, the controller system 15 opens the secondary valve 18 to energize the secondary indoor heat exchanger 8. Energizing the secondary indoor heat exchanger 8 is necessary to bring the cooled air from the primary indoor heat exchanger 7 back into an acceptable range for the set temperature (Ts) for the indoor environment.

Figure 7:
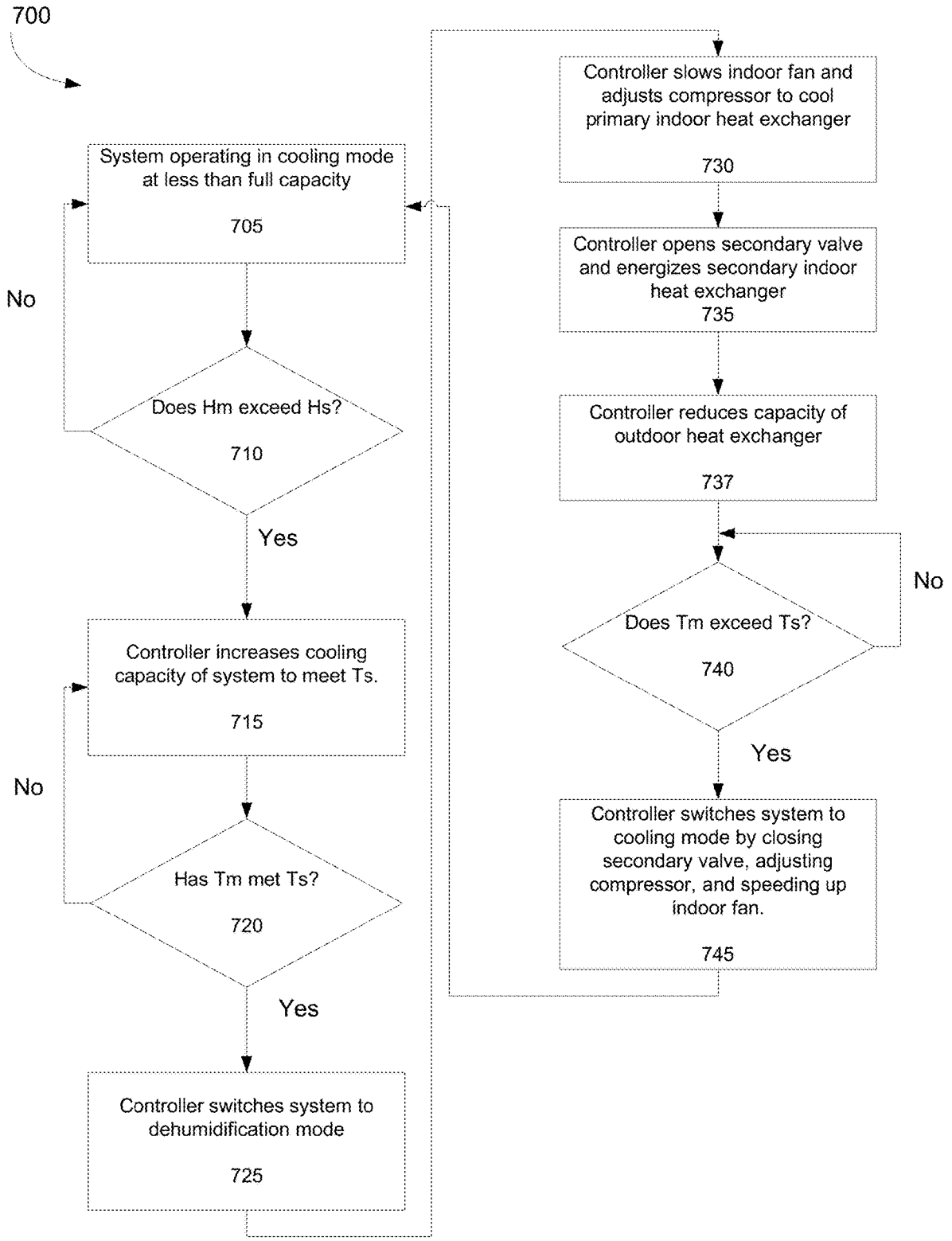
FIG. 7 illustrates a flow chart diagram showing the operation of a controller in accordance with an example embodiment of the present disclosure.

FIG. 7 illustrates an example of an alternate method 700 for operating an air conditioning system 10. The steps of method 700 are the same as method 600 except that method 700 provides an additional step 737 for further optimizing the operation of the air conditioning system 10 while in dehumidification mode. As described in step 737, the controller system 15 can reduce the capacity of the outdoor heat exchanger 1 in order to increase the performance of the secondary indoor heat exchanger 8. Reducing the capacity of the outdoor heat exchanger 1 leaves more heat in the refrigerant for the secondary indoor heat exchanger 8 to transfer to the air before the conditioned air 12 exits the indoor unit 200 and is circulated in the indoor environment. Step 737 can be accomplished in one or more ways. For example, the controller system 15 can reduce the capacity of the outdoor heat exchanger 1 by slowing the outdoor fan 17 or by closing off portions of the coil within the outdoor heat exchanger 1. The controller system 15 can also make mechanical adjustments such as moving louvres or baffles on the outdoor heat exchanger 1 in order to redirect air flow over the surface of the exchanger. As another example, the subcooling heat exchanger 6 disposed at the output of the outdoor heat exchanger 1 can be deactivated thereby reducing the capacity of the outdoor heat exchanger 1 to remove heat from the air conditioning system 10. The remaining steps in example method 700 are similar to those in example method 600 and will not be repeated.

Referring again to example method 600 of FIG. 6, while the air conditioning system 10 is operating in dehumidification mode, the controller system 15 can continually monitor the measured temperature (Tm) from the temperature detector. Likewise, the controller system 15 can receive the measured humidity (Hm) to determine whether a demand for dehumidification remains. Although these steps are shown at a particular sequence as steps 640 and 610 in example method 600, one of skill in the field will understand that the temperature and humidity measurements and the monitoring of these parameters by the controller system 15 can happen at regular intervals throughout methods 600 and 700.

As long as Tm does not exceed Ts and there is a demand for dehumidification, the controller system 15 will continue to operate the air conditioning system 10 in dehumidification mode. However, if Tm exceeds Ts in step 640, the controller system 15 switches the air conditioning system 10 back to cooling mode in step 645.

Decreasing the humidity in an indoor environment creates a more comfortable environment and makes it more likely that people will adjust the set temperature (Ts) to a higher value. Therefore, the foregoing dehumidification mode can provide a more comfortable environment and energy savings.

The example embodiments discussed herein provide an air conditioning system with improved dehumidification functions. The example air conditioning system can be implemented as a complete system comprising an indoor unit and an outdoor unit. Alternatively, aspects of the example embodiments can be implemented using a controller system and the refrigerant circuit of an indoor air handling unit. In alternate embodiments, certain components shown in the figures may be removed or reconfigured.

Although the invention is described with reference to example embodiments, it should be appreciated by those skilled in the art that various modifications are well within the scope and spirit of this disclosure. Those skilled in the art will appreciate that the present invention is not limited to any specifically discussed application and that the embodiments described herein are illustrative and not restrictive. From the description of the example embodiments, equivalents of the elements shown therein will suggest themselves to those skilled in the art, and ways of constructing other embodiments will suggest themselves to practitioners of the art. Therefore, the scope of the present disclosure is not limited to the example embodiments provided herein.

What is claimed is:

1. An air conditioning system comprising:

a temperature detector configured to measure a temperature of an indoor area serviced by the air conditioning system;

a humidity detector configured to measure a humidity of the indoor area;

an outdoor unit comprising:

a condenser coil having a condenser coil input and a condenser coil output;

a compressor having a compressor output in fluid communication with the condenser coil input, the compressor also having a compressor input; and a subcooling heat exchanger connected to the condenser coil output; and an indoor air handling unit comprising:

an evaporator coil having an evaporator coil output in fluid communication with the compressor input, the evaporator coil also having an evaporator coil input;

a reheat coil having a reheat coil output in fluid communication with the evaporator coil input, the reheat coil also having a reheat coil input in fluid communication with the subcooling heat exchanger;

an expansion valve disposed between the reheat coil output and the evaporator coil input; and an indoor fan configured to push or pull air over surfaces of the indoor primary heat exchanger; and a controller system controlling the operation of the air conditioning system such that a cooling capacity of the air conditioning system is increased before the controller system switches the air conditioning system to a dehumidification mode;

wherein the controller is further configured to perform the following operations:

determine that the humidity of the indoor area exceeds a set humidity, increase the operation of the compressor to increase cooling in response to the controller determining that the humidity of the indoor area exceeds the set humidity, determine that the temperature of the indoor area reaches a set temperature after increasing the operation of the compressor, and switch the air conditioning system to a dehumidification mode by slowing the speed of the indoor fan and opening a secondary valve to energize the reheat coil in response to the controller determining that the temperature of the indoor area reaches the set temperature.

2. The air conditioning system of claim 1, wherein a first refrigerant line connects the compressor input and the evaporator coil output.

3. The air conditioning system of claim 2, wherein a second refrigerant line connects the evaporator coil input and the subcooling heat exchanger.

4. The air conditioning system of claim 3, wherein the second refrigerant line also connects to the reheat coil input.

5. The air conditioning system of claim 1, wherein the controller system is further configured to slow the speed of an outdoor fan in response to the controller determining that the humidity of the indoor area exceeds the set humidity.

6. The air conditioning system of claim 1, wherein the controller system is further configured to increase the operation of the compressor to further lower a temperature of the evaporator coil in response to the controller determining that the temperature of the indoor area reaches the set temperature.

7. An air conditioning system comprising:

a temperature detector configured to measure a temperature of an indoor area serviced by the air conditioning system;

a humidity detector configured to measure a humidity of the indoor area;

an outdoor unit comprising:

an outdoor heat exchanger; and a compressor coupled to the outdoor heat exchanger; and a subcooling heat exchanger connected to the outdoor heat exchanger; and an indoor air handling unit comprising:

an indoor primary heat exchanger coupled to the compressor and the outdoor heat exchanger;

an indoor secondary heat exchanger coupled to the indoor primary heat exchanger and the subcooling heat exchanger;

a secondary valve disposed at a secondary input of the indoor secondary heat exchanger; and an indoor fan configured to push or pull air over surfaces of the indoor primary heat exchanger; and a controller system controlling the operation of the air conditioning system such that a cooling capacity of the indoor air handling unit is increased when the air conditioning system is operating in a dehumidification mode, wherein the controller system is further configured to perform the following operations:

determine that the humidity of the indoor area exceeds a set humidity, increase the operation of the compressor to increase cooling in response to the controller system determining that the humidity of the indoor area exceeds the set humidity, determine that the temperature of the indoor area reaches a set temperature after increasing the operation of the compressor, and switch the air conditioning system to a dehumidification mode by slowing the speed of the indoor fan and opening a secondary valve to energize the reheat coil in response to the controller system determining that the temperature of the indoor area reaches the set temperature.

8. The air conditioning system of claim 7, wherein the controller system decreases the capacity of an outdoor heat exchanger and increases the capacity of the secondary indoor heat exchanger when operating in a dehumidification mode.

9. The air conditioning system of claim 8, wherein decreasing the capacity of the outdoor heat exchanger comprises slowing the speed of an outdoor fan.

10. The air conditioning system of claim 7, wherein the primary indoor heat exchanger is an evaporator coil;

the secondary indoor heat exchanger is a reheat coil; and a check valve is disposed at a secondary output of the reheat coil.

11. The air conditioning system of claim 1, wherein the controller is further configured to increase the operation of the compressor to increase cooling in response to the controller determining that the humidity of the indoor area exceeds the set humidity by increasing the frequency of the compressor.

12. The air conditioning system of claim 7, wherein the controller is further configured to increase the operation of the compressor to increase cooling in response to the controller determining that the humidity of the indoor area exceeds the set humidity by increasing the frequency of the compressor.

* * * * *